US010876336B2

(12) United States Patent
Kruedener et al.

(10) Patent No.: US 10,876,336 B2
(45) Date of Patent: Dec. 29, 2020

(54) APPARATUS FOR MOVING A FURNITURE PART WHICH IS RECEIVED ON A FURNITURE CARCASS OF A FURNITURE ITEM

(71) Applicant: Grass GmbH, Reinheim (DE)

(72) Inventors: Boris Kruedener, Kleinostheim (DE); Sebastian Lautenschlaeger, Seeheim-Jugenheim (DE); Martin Staude, Reinheim (DE)

(73) Assignee: Grass GmbH, Reinheim (DE)

( * ) Notice: Subject to any disclaimer, the term of this patent is extended or adjusted under 35 U.S.C. 154(b) by 12 days.

(21) Appl. No.: 16/382,317

(22) Filed: Apr. 12, 2019

(65) Prior Publication Data

US 2019/0316398 A1 Oct. 17, 2019

(30) Foreign Application Priority Data

Apr. 17, 2018 (DE) ..... 20 2018 102 084

(51) Int. Cl.
*E05D 7/12* (2006.01)
*E05D 11/10* (2006.01)
*E05D 3/06* (2006.01)

(52) U.S. Cl.
CPC ..... *E05D 11/10* (2013.01); *E05D 3/06* (2013.01); *E05Y 2900/20* (2013.01)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 4,800,621 A * 1/1989 Rock ..... E05D 7/0407 16/235
4,800,622 A * 1/1989 Rock ..... E05D 7/0407 16/240

(Continued)

FOREIGN PATENT DOCUMENTS

EP 2 559 835 A1 2/2013
EP 1 934 423 B1 12/2013
WO 2007/041736 A1 4/2007

OTHER PUBLICATIONS

Extended European Search Report (Application No. 19168325.9) dated Sep. 19, 2019.

(Continued)

*Primary Examiner* — Chuck Y Mah
(74) *Attorney, Agent, or Firm* — Burr & Brown, PLLC

(57) ABSTRACT

An apparatus for moving a furniture part which is received on a furniture carcass of a furniture item, the apparatus having a guide, by way of which, in the case of a mounted apparatus on the furniture item, the furniture part can be moved out of a closed position into an open position relative to the furniture carcass and back, the furniture part assuming, in the closed position, a position in which it is moved onto a front side of the furniture carcass. The guide is configured as an articulated lever arranged releasably on a mounting member of the apparatus. The apparatus includes a locking mechanism to lock the articulated lever to the mounting member. A locking element of the locking mechanism is arranged on the articulated lever such that it can be moved in a linear manner.

10 Claims, 4 Drawing Sheets

(58) Field of Classification Search
CPC ..... E05F 1/14; E05F 3/20; E05D 3/06; E05D 11/00; E05D 3/16; E05D 11/11; E05Y 2201/21; E05Y 2201/264; E05Y 2201/47; E05Y 2201/492; E05Y 2201/618; E05Y 2900/20; E05Y 2900/202; Y10T 16/5383; Y10T 16/547; Y10T 16/5476; Y10T 16/5357; Y10T 16/5358; Y10T 16/5363; Y10T 16/5367; A47B 2220/0072
See application file for complete search history.

(56) References Cited

U.S. PATENT DOCUMENTS 5,022,116 A * 6/1991 Salice ..... E05D 7/0407 16/258
5,056,189 A * 10/1991 Brustle ..... E05D 7/0407 16/235
5,105,506 A * 4/1992 Lin ..... E05D 7/0407 16/258
5,210,907 A * 5/1993 Toyama ..... E05D 7/0407 16/258
5,224,242 A * 7/1993 Marjanovic ..... E05D 7/125 16/258
5,791,016 A * 8/1998 Lenz ..... E05D 5/0246 16/258
6,032,333 A * 3/2000 Brustle ..... E05D 7/0407 16/240
6,266,848 B1 * 7/2001 Fraccaro ..... E05D 7/0407 16/241
6,675,440 B1 * 1/2004 Lautenschlager ..... E05D 7/125 16/258
7,178,199 B2 * 2/2007 Kashiwaguma ..... E05D 7/125 16/258
7,966,699 B2 6/2011 Dubach et al.
8,468,653 B2 * 6/2013 Tumler ..... E05D 11/10 16/286
8,959,709 B2 * 2/2015 Hasegawa ..... E05D 3/14 16/65
9,169,681 B2 * 10/2015 Cooper ..... E05D 7/123
9,617,773 B2 * 4/2017 Cooper ..... E05D 7/125
9,708,840 B2 * 7/2017 Nuckolls ..... E05D 7/00
9,739,081 B2 * 8/2017 Stuke ..... E05F 5/10
10,494,846 B2 * 12/2019 Schmid ..... E05F 1/1261
2007/0209157 A1 * 9/2007 Kung ..... E05D 15/262 16/240
2007/0257538 A1 * 11/2007 Brunnmayr ..... E05D 15/262 297/423.12
2008/0209682 A1 9/2008 Dubach et al.

OTHER PUBLICATIONS

German Search Report (Application No. 20 2018 102 084.6) dated Mar. 14, 2019.

* cited by examiner

APPARATUS FOR MOVING A FURNITURE PART WHICH IS RECEIVED ON A FURNITURE CARCASS OF A FURNITURE ITEM

This application claims the benefit under 35 USC § 119(a)-(d) of German Application No. 20 2018 102 084.6 filed Apr. 17, 2018, the entirety of which is incorporated herein by reference.

FIELD OF THE INVENTION

The present invention relates to an apparatus for moving a furniture part which is received on a furniture carcass of a furniture item.

BACKGROUND OF THE INVENTION

In the field of furniture, guides such as furniture hinges or flap fittings are known, in order for it to be possible for a furniture part to be moved relative to a furniture carcass.

The guides have to fulfill different requirements; for example, an interior of the furniture carcass and/or the movable furniture part are/is to be made accessible by way of the movement guidance, in order for it to be possible for objects to be stored therein or removed therefrom.

In particular, dismantling of the furniture part from the guide, for example, in the case of a move or a renovation, in the case of which the furniture items have to be moved, for example, is realized in a comparatively impractical manner in the case of known apparatuses.

SUMMARY OF THE INVENTION

It is an object of the present invention to improve an apparatus for moving a furniture part which is received on a furniture carcass of a furniture item, in particular, with regard to comparatively simple mounting and/or dismantling of the furniture part on/from the apparatus which remains on the furniture carcass.

The present invention proceeds from an apparatus for moving a furniture part which is received on a furniture carcass of a furniture item, the apparatus having a guide, by way of which, in the case of a mounted apparatus on the furniture item, the furniture part can be moved out of a closed position into an open position relative to the furniture carcass and back, the furniture part assuming, in the closed position, a position in which it is moved onto a front side of the furniture carcass, the guide being configured as an articulated lever, the articulated lever being configured such that it can be arranged releasably on a mounting member of the apparatus, the mounting member being provided for mounting the apparatus on the movable furniture part, the apparatus comprising a locking mechanism, in order to lock the articulated lever to the mounting member.

The apparatus is configured, for example, as a pivoting fitting or flap fitting for a furniture part, for example, in the form of a top flap of a furniture item. The furniture item, in particular, the furniture carcass, is present, for example, as a wall cabinet.

In the closed position, the furniture part advantageously assumes a position in which it is moved onto a front side of the furniture carcass. For example, an opening of the furniture carcass is closed at least partially in the closed position. There is advantageously a spacing, in particular, a gap, between the furniture part and the furniture carcass in the closed position. For example, an automatic touch-latch opening mechanism which can form, for example, a part of the apparatus can be realized as a result of the gap.

The core concept of the present invention is seen in the fact that a locking element of the locking mechanism is arranged on the articulated lever such that it can be moved in a linear manner, in particular, exclusively. This realizes secure, rapid and comparatively simple mounting or dismantling of the furniture part on/from the apparatus. As a result, mounting or dismantling of the furniture part is advantageously of comparatively comfortable configuration.

Furthermore, it proves advantageous that the locking mechanism comprises a connecting element, the connecting element being present on the mounting member, it being possible for the connecting element to be hooked in on a further locking mechanism on the articulated lever. As a result, comparatively simple positioning of the furniture part is realized.

Two or more connecting elements are advantageously present. For example, the connecting elements (in particular, two connecting elements) are arranged spaced apart from one another on the mounting member. For example, a hooking-in direction of a first connecting element is different than a hooking-in direction of a further connecting element. The connecting element is, for example, of hook-like or hook-shaped configuration. In the mounted state of the mounting member on the furniture part, the connecting element is advantageously present in a manner which projects from a face, in particular, a surface of the furniture part.

It likewise proves advantageous that the locking mechanism has a locking member which is arranged on the articulated lever.

The locking member is configured, for example, as a peg, pin and/or a rivet. For example, the locking member is present in such a way that a first connecting element can be arranged, for example, can be hooked in, on the locking member. The locking member is arranged on the articulated lever, for example, such that it cannot move, in particular, in a stationary manner with respect to further components of the articulated lever. The locking member and the locking element are advantageously present spaced apart from one another on the articulated lever. The apparatus preferably comprises a plurality of locking members, for example, two locking members, in particular, precisely two locking members. The locking members are advantageously present spaced apart from one another on the articulated lever of the apparatus. A spacing of the locking members is, for example, unchangeable.

Moreover, it is advantageous that the locking element is of slide-like configuration. The locking element is mounted on the articulated lever, for example, such that it can be displaced, in particular, such that it can be displaced exclusively in a linear manner. The locking element is advantageously configured in such a way that, in the arranged state of the furniture part on the articulated lever of the apparatus, the locking element has a movement direction along a surface of the furniture part, in particular, parallel to a surface of the furniture part.

Furthermore, it is proposed that the articulated lever has a guide member, by way of which the locking element is guided in a linearly movable manner on the articulated lever. The guide member is present, for example, in the form of a slot or a slit on the articulated lever. For example, an opening and/or cutout of the articulated lever form/forms the guide member. It is also conceivable that the guide member is present on the articulated lever in a projecting manner.

The articulated lever comprises, for example, two articulated arms. The articulated arms of the articulated lever surround, in particular, enclose, a further articulated lever, for example, in the arranged state on the apparatus. It is conceivable that each articulated arm of the articulated lever has in each case one guide member. The articulated arms are, for example, of identical configuration. For example, the articulated arms are of mirror-symmetrical configuration with respect to one another.

In one advantageous variant of the apparatus, the locking mechanism comprises a spring element, the spring element being present on the articulated lever, and the spring element being arranged in such a way that the locking element is pushed in the direction of the locking member. The spring element is configured, for example, as a spring, for example, as a leg spring or a spiral spring. The spring element advantageously pushes the locking element in the direction of a locking position. The spring element is configured, for example, in a region between the articulated arms of the articulated lever. The spring element is configured, for example, in an interior of the articulated lever, in particular, completely.

Moreover, it is advantageous that the locking element has a holding member, the holding member engaging through the guide member of the articulated lever. The holding member is configured, for example, as a peg and/or a pin. The spring element advantageously pushes the holding member of the locking element against a first stop of the guide member. When the locking element bears against the first stop of the guide member, the locking element is in the locking position, for example. The spring element advantageously acts on the holding member. For example, the spring element is connected to the holding member.

Moreover, it is advantageous that the holding member has an angular contour. For example, the holding member has a square contour. For example, the holding member is configured as a cuboid pin and/or peg. As a result, dismantling of the furniture part and/or dismantling of the mounting member from the guide and/or the articulated lever of the guide are/is of comparatively comfortable configuration, in particular, are/is simplified and/or facilitated.

It likewise proves advantageous that the locking element has an actuating element of clip-like configuration. For example, the actuating element is of U-shaped configuration. The holding member advantageously connects the two sides of the U-shaped actuating element to one another, which two sides lie opposite one another and are spaced apart from one another. The actuating element has, for example, one, in particular, two comparatively rough, for example, grooved or structured, holding faces. A user can grip the actuating element in a comparatively slip-proof manner on the holding face.

It is also advantageous that the locking element engages around the articulated lever. For example, the locking element forms an outer side of the articulated lever. The locking element is present, for example, in a mirror-symmetrical manner.

In one advantageous modification of the apparatus, a second connecting element of the mounting member couples to the locking element in the mounted state of the apparatus, the second connecting element having a holding contour, the second connecting element engaging by way of the holding contour around the holding member of the locking mechanism on at least two sides in the mounted state, in particular, on three sides, the holding contour comprising a holding face which, in the arranged state, extends in the direction of a displacement direction of the locking element, the holding face being configured opposite and spaced apart from a surface of the mounting member, the surface forming a surface of the furniture part in the arranged state of the mounting member on the furniture part. For example, the holding face extends parallel to a displacement direction of the locking element. For example, in the arranged state of the furniture part on the articulated lever, the locking element, in particular, the holding member, is present between the holding face and the surface of the furniture part.

In the locking position, the holding member advantageously pushes the second connecting element via the holding face in the direction of the locking member, into which the connecting element is advantageously hooked. As a result, the mounting member and therefore the furniture part are fixed on the articulated lever.

In one advantageous refinement of the apparatus, the locking mechanism has two locking members which are arranged in a stationary manner on the articulated lever, the first locking member coupling to the first connecting element and the second locking member coupling to the second connecting element in the mounted state of the apparatus. In particular, precisely two, in particular, precisely three or more, locking members are advantageously present. The locking members are advantageously arranged on the articulated lever spaced apart from one another. The locking members and the holding member are preferably arranged on the articulated lever spaced apart from one another.

Moreover, a furniture item having an apparatus in accordance with one of the abovementioned embodiments for moving a furniture part which is received on a furniture carcass of a furniture item is proposed.

BRIEF DESCRIPTION OF THE DRAWINGS

Further features and advantages of the present invention are described in greater detail using the exemplary embodiment which is shown diagrammatically in the figures, in which, in detail.

DETAILED DESCRIPTION OF THE INVENTION

Figure 1:
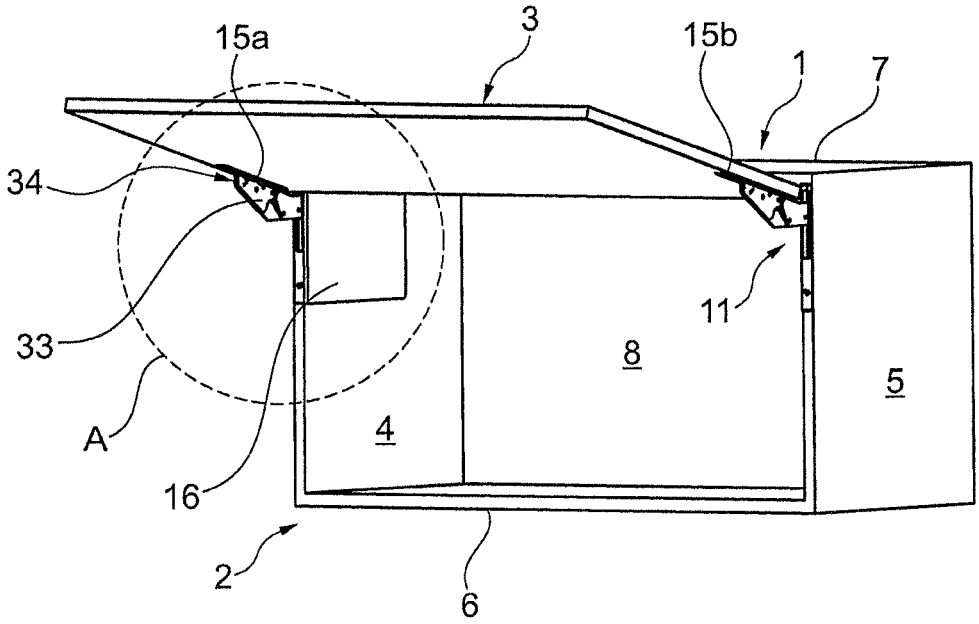
FIG. 1 shows a perspective view of a furniture item according to the present invention having an apparatus according to the present invention for moving a furniture part which is shown in an opened state.
Figure 2:
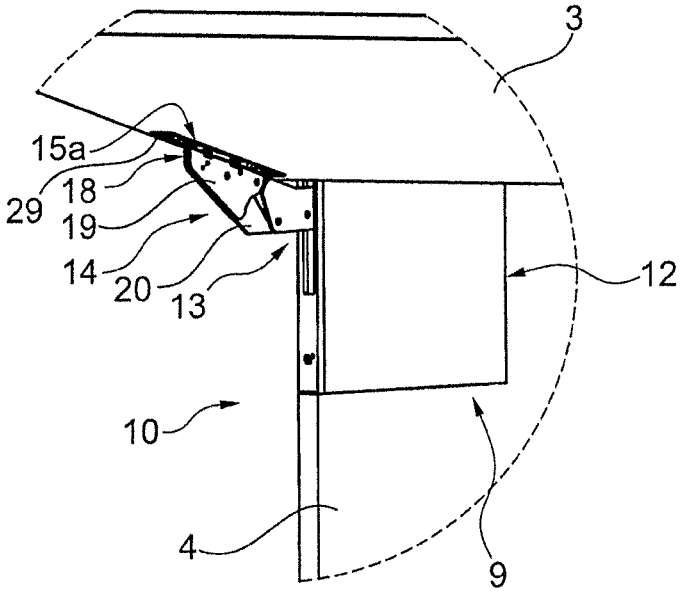
FIG. 2 shows the region A which is outlined in FIG. 1, in an enlarged illustration.

FIG. 1 perspectively shows a furniture item according to the present invention or a wall unit 1 having a box-shaped furniture carcass 2 and a furniture part which is received thereon and is configured as a panel-like upper flap 3 which is shown in an open position relative to the furniture carcass 2.

The furniture carcass 2 comprises two side walls 4 and 5 which lie opposite one another and are connected at the bottom to a bottom side 6 and at the top to a top side 7. On the rear side, the furniture carcass 2 is closed by a rear wall 8.

A movement apparatus according to the present invention which is configured as an upper flap fitting 9 is present for moving the upper flap 3 about a horizontal pivot axis relative to the furniture carcass 2 out of the open position which is shown in FIG. 1 into a closed position (not shown) in which it is moved onto the furniture carcass 2 on the front side. The upper flap fitting 9 has a first fitting unit 10 on the side wall 4 and a second fitting unit 11 on the side wall 5, which fitting units 10, 11 are of similar construction but are side-specific for the functionally correct arrangement on the respective side wall 4 and 5.

Each fitting unit 10 and 11 comprises a base unit 12, guide 13 with articulated levers, and a mounting member in the form of mounting units which comprise in each case one mounting plate 15*a*, 15*b*. The base unit 12 is connected to the mounting plate 15*a*, 15*b* via a plurality of articulated levers which are mounted in an articulated manner and are present as pivoting arms of a pivoting arm arrangement 14, which mounting plate 15*a*, 15*b* is fastened fixedly to an inner side of the upper flap 3, for example, in a countersunk manner in a material recess.

Figure 3:
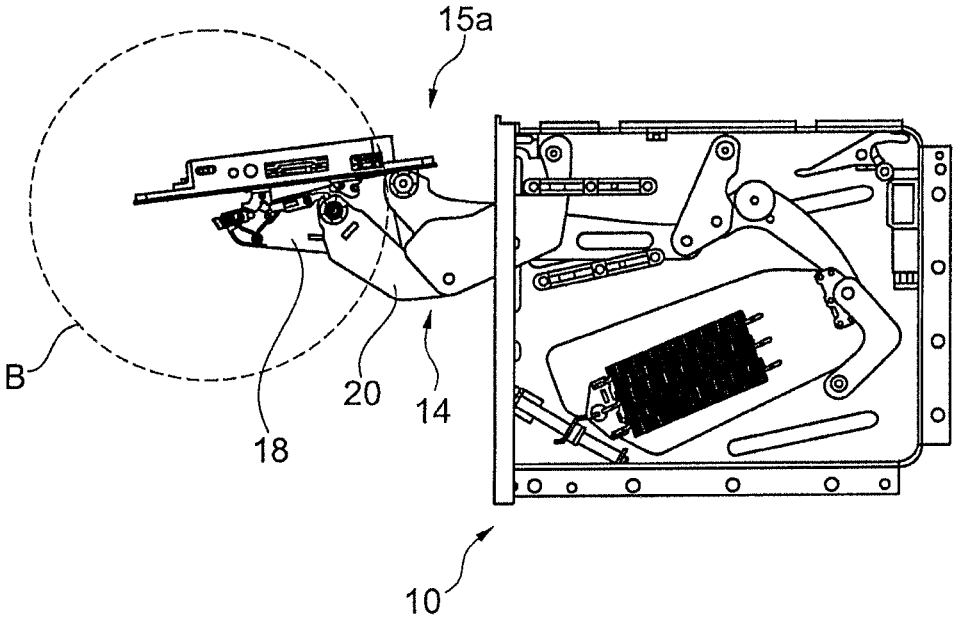
FIG. 3 shows an illustration of the apparatus from the side, FIG. 3 showing a first mounting step for mounting the mounting member of the apparatus on a guide of the apparatus, parts of the apparatus being shown transparently for improved comprehension.

FIG. 3 shows the fitting unit 10 of the upper flap fitting 9 in a state in which it is not yet mounted on the wall unit 1. Parts of the fitting unit 10 have been shown transparently for improved comprehension; these include, inter alia, a lateral covering flap 16 and a lever arm of an articulated lever.

A first articulated lever 17 of the pivoting arm arrangement 14 advantageously comprises a first lever arm 18 and a second lever arm 19, the second lever arm 19 being shown transparently in FIGS. 3 to 9 for improved comprehension of the apparatus. The two lever arms 18, 19 of the first articulated lever 17 are advantageously present in an identical manner. It is also conceivable that the lever arms 18, 19 are present in a mirror-symmetrical manner with respect to one another.

Figure 4:
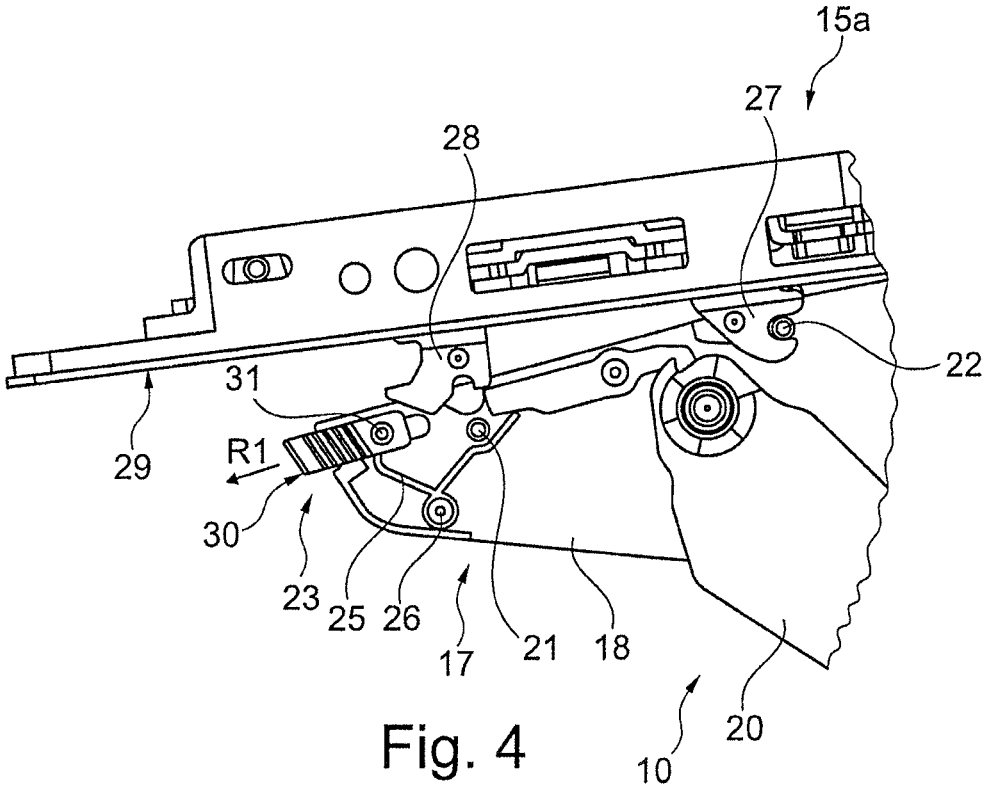
FIG. 4 shows an enlarged illustration of detail B according to FIG. 3.

A second articulated lever 20 of the pivoting arm arrangement 14 advantageously comprises a single lever arm. The second articulated lever 20 is mounted movably, for example, between the two lever arms 18, 19 of the first articulated lever 17. The first and the second articulated lever 17, 20 are preferably connected movably to one another (FIG. 4).

For example, the first articulated lever 17 comprises two locking members in the form of pins 21, 22. The pins 21, 22 are advantageously arranged on the articulated lever 17 spaced apart from one another. For example, the pins 21, 22 are present in a projecting manner on a lever arm 18, 19. For example, the lever arms 18, 19 are connected to one another by means of the pins 21, 22. In particular, the lever arms 18, 19 are present in a manner which is spaced apart from one another by way of the pins 21, 22.

Figure 9:
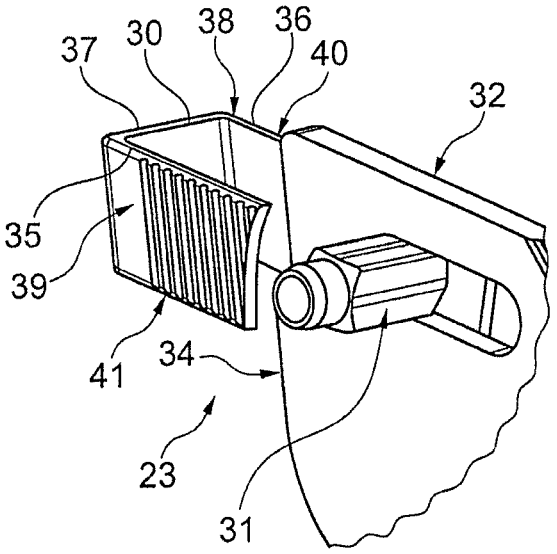
FIG. 9 shows a perspective detailed view of a locking element of a locking mechanism of the apparatus, parts of the apparatus being shown transparently for improved comprehension.

Furthermore, a locking element 23 is configured on the first articulated lever 17, which locking element 23 is present, for example, on the first articulated lever 17 such that it can be moved in a linear manner by means of a guide member in the form of a guide contour 24 (see also FIG. 9). The guide contour 24 is, for example, configured in a slot-like manner, in particular as a slit or as a slot.

In addition, for example, a spring element in the form of a leg spring 25 is arranged on the first articulated lever 17. The leg spring 25 is connected, for example, to the locking element 23. The leg spring 25 is held on the first articulated lever 17, for example, at a mounting point 26.

Figure 6:
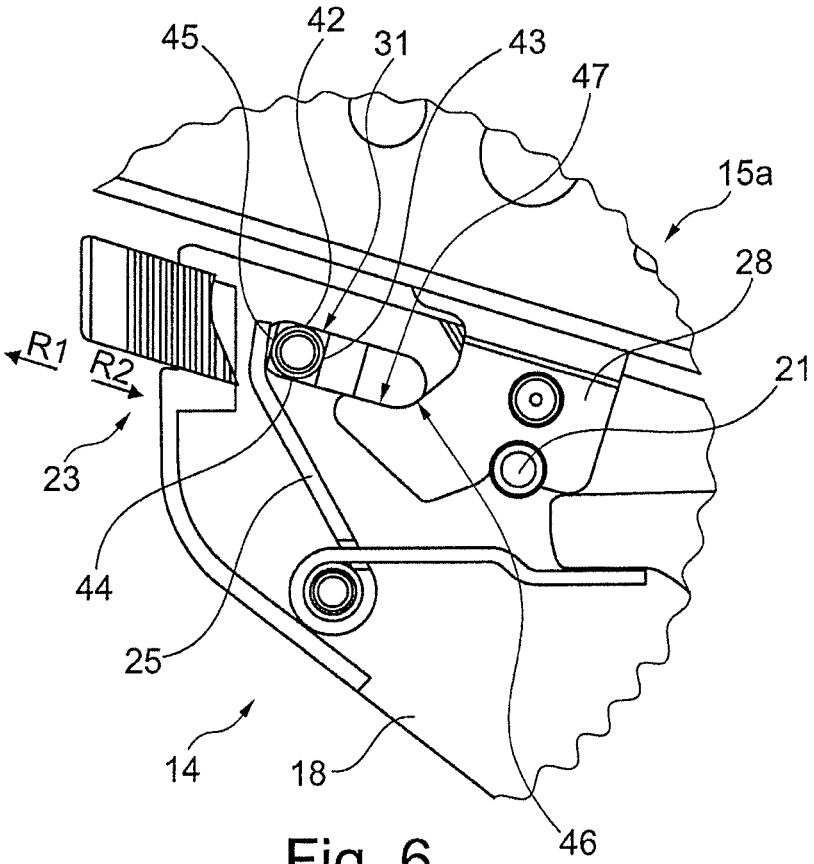
FIG. 6 shows an enlarged illustration of detail C according to FIG. 5, FIGS. 5 and 6 showing a further mounting step for mounting the mounting member of the apparatus on the guide of the apparatus, parts of the apparatus being shown transparently for improved comprehension.

For example, two connecting elements 27, 28 which are spaced apart from one another are configured on the mounting plate 15*a*. The connecting elements 27, 28 are configured, for example, so as to project from a surface 29 of the mounting plate 15*a*. For example, the connecting elements 27, 28 are present in a hook-like manner. In the arranged state of the mounting plate 15*a* on the first articulated lever 17, in each case one connecting element 27, 28 advantageously engages around a pin 21, 22 (FIGS. 3 and 6). For example, a first connecting element 27 is hooked onto the pin 22 during a mounting operation of the mounting plate 15*a* onto the first articulated lever by means of a pivoting movement (FIG. 4).

For example, the locking element 23 comprises a U-shaped actuating element 30 which is, in particular, clamp-like, and a pin-shaped holding member 31. The actuating element 30 advantageously comprises a first long side element 35, a second long side element 36 and a short side element 37. The two long side elements 35, 36 of the actuating element 30 are advantageously present opposite one another and are spaced apart from one another. For example, the short side element 37 connects the two long side elements 35, 36 to one another at a first end of the long side elements 35, 36, in particular, at a first end of the actuating element 30. The three side elements 35-37 are advantageously configured in one piece. The holding member 31 advantageously connects the two long side elements 35, 36 to one another at a second end of the long side elements 35, 36, in particular, at a second end of the actuating element 30. For example, the holding member 31 is mounted on the side elements 35, 36. In the arranged state, the actuating element 30 encloses, in particular, covers, an outer side 32 of the lever arm 18 and an outer side 33 of the lever arm 19. In particular, the actuating element 30 covers an end side 34 of the first articulated lever 17.

Holding faces 40, 41 are advantageously present on outer sides 38, 39 of the long side elements 35, 36. The holding faces 40, 41 are, for example, of comparatively rough or slip-proof configuration, with the result that an installer can grip the actuating element 30 in a comparatively secure manner. The holding faces 40, 41 have, for example, a structured surface, for example, a surface with grooves or depressions (see, in particular, FIG. 9).

The holding member 31 advantageously engages through the guide contour 24. In the arranged state of the locking element 23 on the first articulated lever 17, the locking element 23 is therefore configured captively on the first articulated lever 17.

The holding member 31 is advantageously present at least in sections in a rod-shaped manner, in particular, in a cuboid manner. In cross section, in particular, transversely with respect to a longitudinal axis of the holding member 31, the holding member 31 has, for example, a cuboid cross section, in particular, a square cross section. For example, the holding member 31 has four (in particular, planar) side faces 42 to 45 which are configured in a rectangle with respect to one another in a cross section as viewed in a side face plane of the side faces.

Figure 5:
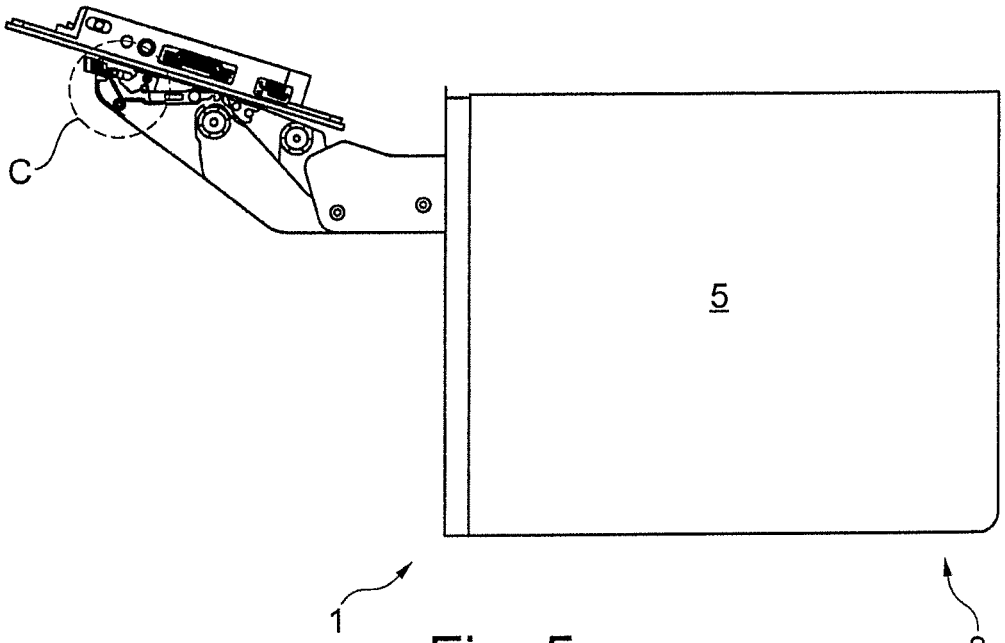
FIG. 5 shows a view from the side of the furniture item according to FIG. 1, parts of the guide of the apparatus and the furniture item being shown transparently for improved comprehension.
Figure 8:
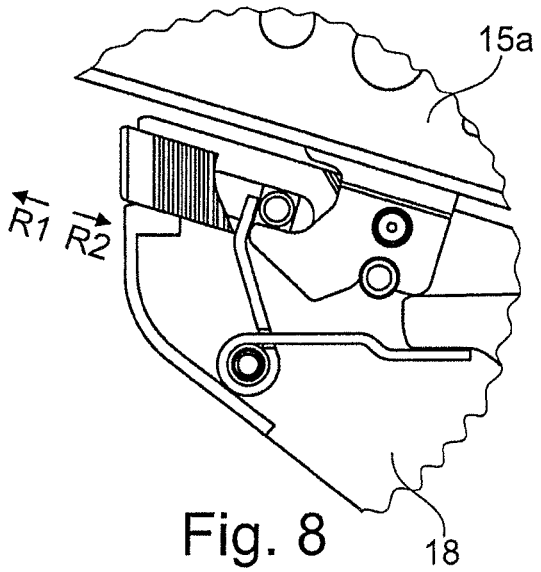

FIGS. 5, 6 and 8 do not show parts of the side element 35 for improved visualization.

In the following text, mounting of the mounting plate 15*a* on the first articulated lever 17 will be described using FIGS. 4, 6 and 8. First of all, the locking element 23 is moved by an installer in the direction R1 counter to a spring force of the leg spring 25 into an unlocked position of the locking element 23 (FIGS. 4 and 9). In the unlocking position, the locking element 23 lines up, in particular, with a side face of the holding member 31 at one end of the guide contour 24. As a result, the first connecting element 27 of the mounting plate 15*a* can be hooked onto the pin 22 by way of a pivoting movement, with the result that the second connecting element 28 can be placed onto the pin 21 (FIGS. 6 and 8).

Subsequently, the installer releases the locking element 23, and the leg spring 25 then moves the locking element 23 in the direction R2 into a locking position (FIG. 8). In the locking position, the locking element 23 lines up, in particular, with a further side face of the holding member 31 at a further end of the guide contour 24.

In the locking position, the second connecting element 28 engages around the holding member 31 with its holding contour 46. The holding contour 46 comprises a holding face 47. The holding member 31 is advantageously in contact with the holding face 47 in the locking position (FIG. 8).

In the arranged state of the mounting plate 15*a* on the first articulated lever 17, a displacement direction R1, R2 is advantageously oriented parallel to the surface 29 of the mounting plate 15*a*. The displacement directions R1 and R2 are present, for example, parallel to one another.

Figure 7:
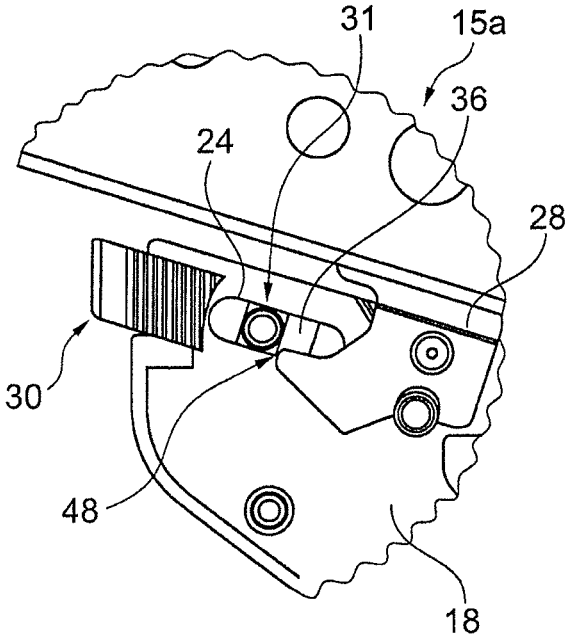
FIGS. 7 and 8 show further mounting steps of the apparatus from a perspective from the side in an excerpt corresponding to detail C from FIG. 5, parts of the apparatus being shown transparently for improved comprehension.

An unlocking operation, starting from the locking position according to FIG. 8, takes place in such a way that an installer moves the locking element 23 in the direction of the unlocked position R1 counter to the spring force of the leg spring 25. A release of the mounting plate 15*a* from the first articulated lever 17 is possible from that moment in the unlocking movement of the locking element 23, at which moment an outer edge 48 of the second connecting element 28 can be moved past the holding member 31 (FIG. 7).

On account of the cuboid configuration of the holding member 31, a comparatively small travel path, transversely with respect to a displacement direction of the locking element 23, is necessary for dismantling the mounting plate 15*a* from the first articulated lever 17 (FIG. 7) in comparison with a configuration of the holding member 31 which is, for example, round, in order to move the connecting element 28 with the outer edge 48 past the holding member 31 in such a way that the holding member 31 is blocked and can no longer be moved back into the locking position with the connecting element 28 according to FIG. 8.

LIST OF DESIGNATIONS

1 Wall unit
2 Furniture carcass
3 Upper flap
4 Side wall
5 Side wall
6 Bottom side
7 Top side
8 Rear wall
9 Upper flap fitting
10 Fitting unit
11 Fitting unit
12 Base unit
13 Guide
14 Pivoting arm arrangement
15*a*, 15*b* Mounting plate
16 Covering cap
17 Articulated lever
18, 19 Lever arm
20 Articulated lever
21, 22 Pin
23 Locking element
24 Guide contour
25 Leg spring
26 Mounting point
27, 28 Connecting element
29 Surface
30 Actuating element
31 Holding member
32, 33 Outer side
34 End side
35-37 Side element
38, 39 Outer side
40, 41 Holding face
42-45 Side face
46 Holding contour
47 Holding face
48 Outer edge

The invention claimed is:

1. An apparatus for moving a movable furniture part associated with a furniture carcass, the apparatus comprising:

a mounting member for mounting the apparatus on a movable furniture part associated with a furniture carcass;

a guide comprising an articulated lever that is releasably arranged on the mounting member, wherein the articulated lever is adapted to move the movable furniture part from a closed position proximate a front side of the furniture carcass to an open position relative to the furniture carcass and back; and at least a first locking mechanism that locks the articulated lever to the mounting member, wherein the first locking mechanism comprises a first locking element arranged on the articulated lever such that the first locking element is adapted to move in a linear manner, wherein the articulated lever includes a guide member that enables the first locking element to be moved in a linear manner on the articulated lever, wherein the first locking element includes a holding member that engages through the guide member of the articulated lever, and wherein an outer surface of the holding member has an angular contour.

2. The apparatus of claim 1, wherein the first locking mechanism comprises a first connecting element present on the mounting member, wherein the first connecting element is adapted to be hooked in on a second locking mechanism provided on the articulated lever.

3. The apparatus of claim 2, wherein the second locking mechanism has a second locking member arranged on the articulated lever.

4. The apparatus of claim 2, wherein the first locking mechanism further comprises a second connecting element coupled to the mounting member, wherein the second connecting element has a holding contour, wherein the second connecting element engages the holding member of the first locking mechanism on at least two sides thereof via the holding contour, wherein the holding contour comprises a holding face that extends in a displacement direction of the first locking element, and wherein the holding face is configured opposite and spaced apart from a surface of the mounting member that forms a surface of the movable furniture part.

5. The apparatus as claimed in claim 4, wherein the first locking mechanism comprises a first locking member and a second locking member, which are arranged in a stationary manner on the articulated lever, wherein the first locking member is coupled to a first connecting element and the second locking member is coupled to the second connecting element in a mounted state of the apparatus.

6. The apparatus of claim 1, wherein the first locking element has a slide-like configuration.

7. The apparatus of claim 1, wherein the first locking mechanism comprises a spring element present on the articulated lever, and wherein the spring element is arranged such that the first locking element is biased toward the first locking member.

8. The apparatus of claim 1, wherein the first locking element includes an actuating element having a clip-like configuration.

9. The apparatus of claim 1, wherein the first locking element forms an outer side of the articulated lever.

10. A furniture item comprising the apparatus of claim 1.

* * * * *